United States Patent [19]

Yui et al.

[11] Patent Number: 4,749,981

[45] Date of Patent: Jun. 7, 1988

[54] RESINOUS RESISTOR

[75] Inventors: Hiroshi Yui; Michiya Okamura; Michio Ohmori, all of Mie, Japan

[73] Assignee: Mitsubishi Petrochemical Co., Ltd., Tokyo, Japan

[21] Appl. No.: 925,562

[22] Filed: Oct. 31, 1986

[30] Foreign Application Priority Data

Nov. 19, 1985 [JP] Japan ..... 60-259414

[51] Int. Cl.[4] ..... H01C 8/00

[52] U.S. Cl. ..... 338/225; 338/275; 428/474.4

[58] Field of Search ..... 219/553, 505; 264/105; 338/22 R, 225 D, 212, 275, 225; 428/474.4, 480

[56] References Cited

U.S. PATENT DOCUMENTS 4,315,237 2/1982 Middleman et al. ..... 338/22 R

FOREIGN PATENT DOCUMENTS 47843 4/1977 Japan .
152580 11/1979 Japan .
197763 10/1985 Japan .
89258 5/1986 Japan .

OTHER PUBLICATIONS

Encyclopedia of Chemical Technology, 3rd ed., vol. 4; "Carbon Black" pp. 631-637; 1978.

*Primary Examiner*—E. A. Goldberg
*Assistant Examiner*—M. N. Lateef
*Attorney, Agent, or Firm*—Oblon, Fisher, Spivak, McClelland & Maier

[57] ABSTRACT

A resinous resistor made of a blend of a thermoplastic non-polar resin, a thermoplastic polar resin, graphite and carbon black. The volume inherent resistance value of the resistor can be precisely controlled to a predetermined value. The resistor is uniform in resistance.

20 Claims, No Drawings

RESINOUS RESISTOR

FIELD OF THE INVENTION

The present invention relates to a resinous resistor having a precisely controlled electric resistance.

BACKGROUND OF THE INVENTION

The following four types of resistors are generally used: (1) a wound resistor which is prepared by winding a Cu-Ni-base or Ni-Cr-base resistance wire around a winding core; (2) a metal coating resistor which is prepared by providing a thin film of Cr-$SiO_2$ or $Ta_2O_5$ on an insulator by vacuum evaporation or sputtering; (3) a thermet resistor which is prepared by mixing a glassy binder and Ru-base electrically conductive particles and then sintering the resulting mixture at elevated temperatures; and (4) a carbon resistor which is prepared by mixing a binder and carbon to prepare a paste, coating the paste on an insulator and then sintering the paste coating.

These resistors can be used satisfactorily for the usual purposes. However, they fail to satisfy the requirements described below and thus they are unsatisfactory for use in applications where these requirements are needed. Thus, a new resistor fulfilling these requirements has been desired.

Namely (1) The resistance value of such a resistor must be not less than 1M ($10^6$)Ω, its size must be small, and its production cost must be low.

Specified metal coating resistors having a resistance value ranging between 1 and 30MΩ are now on the market. These resistors, however, are extremely expensive. Commercially available resistors having a resistance value exceeding 30MΩ are more expensive and, furthermore, are large-sized. Thus, these resistors are used only for specific purposes.

(2) The resistor has a complicated or specified shape and possesses the performance as a mechanic part.

A resistance value R (Ω) of a resistor, and a volume inherent resistance $\rho$ (Ω.cm), a cross section S ($cm^2$) and a length l (cm) of a material constituting the resistor have the following relation:

$$R=(\rho l)/S$$

If it is desired to set the resistance value R at a predetermined value, it is necessary to precisely control the volume inherent resistance. It is difficult, however, to precisely control the volume inherent resistance of a material having moldability. Materials having a volume inherent resistance in the range of $1\times10^6$ to $1\times10^{13}$ Ω.cm and further excellent in moldability have not been obtained.

Investigations have been made on the production of resistors having a volume inherent resistance of $1\times10^6$ to $1\times10^{13}$ Ω.cm by molding a composition prepared by mixing and kneading a thermoplastic resin and electrically conductive fillers such as carbon black, carbon fibers, metal fibers and metal flakes by molding techniques such as injection molding and extrusion molding.

Resinous resistors can be molded into complicated shapes and are believed to be extremely useful as resistors functioning as mechanical parts having a high mechanical strength and so forth. In practice, however, they have not yet been put into practical use because their volume inherent resistance is quite difficult to control.

The present inventors thought that the main reason for which prior art resinous resistors have not been put into practical use was that the dispersion state of electrically conductive fillers was not precisely controlled. As a result of extensive investigations, they have found that the volume inherent resistance can be precisely controlled by using a combination of graphite and carbon black as an electrically conductive filler. Based on these findings, the present invention has been accomplished.

SUMMARY OF THE INVENTION

An object of the present invention is to provide a resinous resistor the volume inherent resistance of which is precisely controlled.

Another object of the present invention is to provide a resinous resistor which is uniform in resistance and is excellent in moldability.

Still another object of the present invention is to provide a resinous resistor which is high in resistance value and is low in production cost.

It has now been discovered that the above objects can be attained by a resinous resistor produced by comprising kneading and molding a resin composition comprising:

| | |
|---|---|
| Thermoplastic non-polar resin | 40 to 90 wt % |
| Thermoplastic polar resin | 0.5 to 30 wt % |
| Graphite | 5 to 30 wt % |
| Carbon black | 1 to 20 wt % |

and further satisfying the following relation:

$$(c\times d)/(a\times b)=0.5 \text{ to } 15$$

wherein a indicates an oxygen content of carbon black (wt%), b indicates an amount of carbon black compounded (wt%), c indicates a polar group-containing monomer content (by mol) of the thermoplastic polar resin (%), and d indicates an amount of the thermoplastic polar resin compounded (wt%).

DETAILED DESCRIPTION OF THE INVENTION

In the present invention, a combination of graphite and carbon black is used as an electrically conductive filler. Graphite forms an electrically conductive structure ranging between several microns and several tens microns in the matrix of a thermoplastic non-polar resin, and finely divided carbon black particles are dispersed in the clearance between graphite particles. If the mutual interaction between the polar group on the carbon black surface and the thermoplastic resin is properly controlled in the above condition, the volume inherent resistance can be precisely controlled. Furthermore, a resinous resistor the volume inherent resistance of which is uniform through the molding can be obtained. This resinous resistor can be formed in a complicated shape with high dimensional accuracy.

Suitable examples of thermoplastic non-polar resins which are used in the present invention as the matrix resin are polyolefin-based resins and polystyrene-based resins. More specifically, olefin polymers such as polyethylene (e.g., low density polyethylene, high density polyethylene, intermediate density polyethylene and straight chain low density polyethylene), polypropylene, polybutene, polyhexene, polymethylpentene, a propylene-ethylene block copolymer, a propylene-ethylene random copolymer, a propylene-butene copolymer, a propylene-butene-ethylene terpolymer, etc., copolymers of olefins and other olefins, styrene polymers such as polystyrene, poly(α-methylstyrene), poly(4-methylstyrene), etc., mixtures of the above polymers or copolymers, and mixtures of the above polymers or copolymers with a rubber component such as propylene-ethylene copolymer rubber, butadiene rubber, styrene-butadiene rubber, hydrogenated styrene-butadiene-styrene copolymer, etc., can be suitably used.

Thermoplastic polar resins which are used in the present invention are polymers having a polar group in the main and/or side chain and containing O, N, S and/or a halogen atom. Representative examples are thermoplastic resins having at least one polar group selected from a carboxyl group, an acid anhydride group, an amino group, an amido group, an imido group, a hydroxyl group, an epoxy group, an ester group, an alkoxyl group, a mercapto group and a sulfurous acid group. For example, polyamide, polyester, homopolymers or copolymers containing as the structural unit acrylic acid, methacrylic acid, acrylic ester, methacrylic acid ester, acrylic amide and/or methacrylic acid amide, such as polyacrylic acid, polymethacrylic acid, polyacrylate, polyacrylamide, polymethacrylamide, polymethacrylate, copolymers of ethylene with acrylic acid, methacrylic acid, acrylic esters and/or acrylic amide, an ethylenepiperidyl acrylate copolymer, an ethylene-ethyl acrylateglycidyl acrylate copolymer, etc., polyolefins or polystyrenes grafted with acrylic acid, methacrylic acid, acrylic ester, methacrylic acid ester, acrylic amide, methacrylic acid amide, maleic anhydride and/or maleimide compounds, such as maleic anhydride-grafted polypropylene, maleic anhydride-grafted propylene-ethylene block copolymer, maleic anhydride-grafted polyethylene, maleic anhydride-grafted polystyrene, acrylic acid-grafted polypropylene, acrylic acid-grafted polyethylene, acrylic acid-grafted polystyrene, maleimide-grafted polypropylene, maleimide-grafted polyethylene, maleimide-grafted polystyrene, etc., are included.

These thermoplastic polar resins function to control the dispersion state of carbon black in the clearance between the electrically conductive fillers, particularly, graphite particles by the formation of the mutual interaction such as a hydrogen bonding between the polar group of the thermoplastic polar resin and the polar group on the surface of carbon black. As described hereinafter, the amount of polar groups on the surface of carbon black varies with the type of carbon black. Therefore, the amount of the thermoplastic polar resin compounded is controlled depending on the amount of carbon black and the desired volume inherent resistance value.

Carbon black which is used in the present invention is selected from furnace black, Ketjen black, thermal black, acetylene black and channel black. Various polar groups such as a hydroxyl group, a carboxyl group, a carbonyl group, a lactone group, etc., are present on the surface of carbon black, and almost all of these polar groups contain oxygen. Thus, the amount of oxygen in carbon black as determined by an elemental analysis is almost correspondent to the amount of surface polar groups.

The oxygen content of the usual carbon black is in the range of 0.05 to 10 wt%, and this oxygen content varies depending on the process of production of carbon black in the above range. The oxygen content is 0.4 to 5 wt% in furnace black, 0.05 to 2 wt% in acetylene black, 2 to 10 wt% in channel black and 1 to 7 wt% in Ketjen black. The oxygen content can be controlled by treatment such as hydrogen reduction. Carbon black treated with hydrogen can be used.

Graphite which is used in the present invention includes natural graphite produced by purifying and finely dividing the natural graphite product, and artificial graphite produced by using petroleum coke, etc., as the starting material and converting it into graphite at temperatures as high as not less than 2,000° C., and has an average particle diameter of 1 to 50 μm, preferably 5 to 30 μm. The average particle diameter is determined from a point of 50% in a particle size distribution cumulative curve as measured by the light transmission method of the liquid phase precipitation system.

The proportion of each component in the composition of the present invention is shown below.

| | Usually (wt %) | In Preferred Embodiment for Production of Resistor Having Volume Inherent Resistance of $1 \times 10^6$ to $1 \times 10^{10}$ Ω · cm (wt %) | In Preferred Embodiment for Production of Resistor Having Volume Inherent Resistance of $1 \times 10^9$ to $1 \times 10^{13}$ Ω · cm (wt %) |
|---|---|---|---|
| Thermoplastic Non-Polar Resin | 40 to 90 | 60 to 90 | 40 to 70 |
| Thermoplastic Polar Resin | 0.5 to 30 | 0.5 to 15 | 10 to 30 |
| Graphite | 5 to 30 | 10 to 25 | 10 to 25 |
| Carbon Black | 1 to 20 | 1.5 to 15 | 5 to 20 |

The amount of the thermoplastic polar resin is controlled depending on the amount of oxygen contained in carbon black.

More specifically, the amount of the thermoplastic resin is determined so as to satisfy the following relation:

$$(c \times d)/(a \times b) = 0.5 \text{ to } 15$$

wherein a indicates an oxygen content of carbon black compounded (wt%), b indicates an amount of carbon black compounded (wt%), c indicates a content (by mol) of a monomer component having a polar group in the thermoplastic polar resin (%), and d indicates an amount of the thermoplastic polar resin compounded (wt%).

The value $$\left(\frac{c \times d}{a \times b}\right)$$

is 0.5 to 4, preferably 0.5 to 2.5 in the production of resinous resistors having a volume inherent resistance of $1\times10^6$ to $1\times10^{10}$ Ω.cm, and is 3 to 15 in the production of resinous resistors having a volume inherent resistance of $1\times10^{10}$ to $1\times10^{13}$ Ω.cm. Particularly, the value is preferably 3 to 10 in the production of resinous resistors having a volume inherent resistance of $1\times10^{10}$ to $1\times10^{12}$ Ω.cm, and is preferably 9 to 15 in the production of resinous resistors having a volume inherent resistance of $1\times10^{11}$ to $1\times10^{13}$ Ω.cm.

If the proportion of graphite is in excess of 30 wt%, it is difficult to produce resistors having a volume inherent resistance of not more than $1\times10^{13}$ Ω.cm. On the other hand, if the proportion of graphite is less than 5 wt%, it is difficult to precisely control the volume inherent resistance.

If the proportion of carbon black is in excess of 20 wt%, it is difficult to produce resistors having a volume inherent resistance of not more than $1\times10^{13}$ Ω.cm. On the other hand, if it is less than 1 wt%, the volume inherent resistance is difficult to precisely control.

If the thermoplastic polar resin is added in such amounts that the value $(c\times d)/(a\times b)$ is in excess of 15, the volume inherent resistance of not more than $1\times10^{13}$ Ω.cm is difficult to precisely control. On the other hand, if the thermoplastic polar resin is used in such amounts that the value is less than 0.5, the volume inherent resistance of not less than $1\times10^6$ Ω.cm is difficult to design.

In the case where the thermoplastic polar resin is a copolymer of a non-polar monomer and a polar group-containing monomer, c indicates the mol content (%) of the polar group-containing monomer. In the case where the thermoplastic polar resin is a copolymer produced by graft copolymerization of a polar group-containing monomer onto a non-polar polymer, the mol amount of the monomer constituting the non-polar polymer is calculated, and from the above calculated value and the mol amount of the polar group-containing monomer grafted, the polar group-containing monomer content (c) is calculated.

Preferably, copolymers or graft copolymers having a polar group-containing monomer content (c) of not more than 10%, more preferably 3 to 0.05%, are added in the above defined range.

The volume inherent resistance value is determined as follows. A test piece having a length of 1.5 cm and a width of 1 cm is cut away from a molding having a thickness of d cm. 2 mm portions on both ends in the lengthwise direction of the test piece (both front and back surfaces) are coated with a silver paste. Two leading wires are bonded to the silver pastes coated on both the front and back surfaces in one end of the test piece and the two leading wires are collected to form one leading wire. The thus obtained leading wire and another leading wire bonded to the silver pastes in another end of the test piece in the same manner as above are connected to TR 8601 High Megohm Meter (manufactured by Takeda Riken Co., Ltd.). The resistance value R (Ω) of the test piece is measured at an applied voltage of 100 V. Based on the thus measured resistance value R and the thickness d (cm) of the test piece, the volume inherent resistance value ρ (Ω.cm) is calculated from the following equation:

$$\rho = \frac{1 \times d}{1.5} \times R$$

In the present invention, as well as the thermoplastic non-polymer resin, thermoplastic polar resin, graphite and carbon black, various additives can be compounded within ranges not seriously changing the volume inherent resistance value.

More specifically, phenol-based antioxidants such as 2,6-di-tert-butyl-4-methylphenol, 1,1,3-tri(2-methyl-4-hydroxy-5-tert-butylphenyl)butane, tetrakis[methylene(3,5-di-tert-butyl-4-hydroxyhydrocinnamic acid ester)]methane, n-octadecyl-β-(4'-hydroxy-3',5'-di-tert-butylphenyl)propionic acid ester, etc.; sulfur-based antioxidants such as dilaurylthiodipropionic acid ester, distearylthiodipropionic acid ester, laurylstearylthiodipropionic acid ester, tetrakis(methylene-3-dodecylthiopropionic acid ester)methane, etc.; phosphorus-based antioxidants such as di(dinonylphenyl)-mono-(p-nonylphenyl)phosphite, etc.; higher fatty acid-based lubricants such as stearic acid, oleic acid, etc., higher fatty acid metal salt-based lubricants such as calcium stearate, magnesium stearate, barium stearate, zinc stearate, calcium oleate, magnesium oleate, aluminum oleate, etc., higher fatty acid amide-based lubricants such as stearic acid amide, etc., and higher fatty acid ester-based lubricants such as ethyl stearate, etc.; organic or inorganic pigments such as aniline black, iron black, titanium yellow, quinacridone, phthalocyanine blue, etc.; ultraviolet ray absorbents such as 2-(2'-hydroxy-3',5'-di-tert-butylphenyl)-5-chlorobenzotriazole, 2-hydroxy-4-n-octoxybenzophenone, etc.; antistatic agents such as stearic acid monoglyceride, N,N-bis(2-hydroxyethyl)alkylamine, etc.; dispersing agents; copper influence-preventing agents; neutralizing agents; expanding agents; expansion preventing agents; and flame retardants can be compounded.

The composition is mixed by the use of the usual mixer, and then kneaded and pelletized by the use of kneading machines such as a mono-screw extruder, a twin-screw extruder, a Banbury mixer, a roll, etc. These pellets are molded into the desired formed resinous resistor.

Kneading is carried out so that the volume inherent resistance is uniform through the whole of the resinous resistor.

In general, it is necessary for kneading to be carried out so that the ratio of maximum volume inherent resistance value ($R_{max.}$) to minimum volume inherent resistance value ($R_{min.}$) at every point in the resinous resistor is not more than 100/1 and preferably not more than 10/1. It is one of the features of the resin composition of the present invention that a resinous resistor having a uniform volume inherent resistance can be easily produced. Workers skilled in resin compounding can easily produce a uniform resinous resistor by known techniques.

In molding, all molding methods of thermoplastic resins, such as inflation film molding, casting film molding, sheet molding, blow molding, profile extrusion molding, expansion molding extrusion, injection molding, expansion injection molding, compressing molding, etc., can be applied.

A master batch containing larger amounts of graphite and carbon black is previously kneaded to produce master batch pellets. These pellets are again kneaded with a resin component and then molded by techniques such as injection molding, extrusion molding, etc., or master batch pellets are mixed with a resin component and then molded by techniques such as injection molding, extrusion molding, etc. In special cases, the composition is mixed and directly kneaded and molded with an injection molding machine or an extrusion molding machine.

The resinous resistor can be shaped in any desired shape such as a plate, a bar, a pipe, a sheet, a film, a disc, etc.

Depending on the purpose, two or more resinous resistor materials each having the different volume inherent resistance may be molded into a laminate by techniques such as coextrusion, double injection, etc., or a plurality of moldings may be produced using a plurality of the resinous resistor materials and then bonded or laminated.

In laminated or bonded materials, the whole may be made up of the resinous resistor of the present invention, or some layers may be made up of the resinous resistor of the present invention.

The resistor thus produced has a complicated shape or a special shape and further has a performance as a mechanical part. Thus, the resistor is quite useful as a new type resistor part. Furthermore, resistors having a resistance value of 1 to 30MΩ which have been produced from expensive metal coating type resistors can be provided inexpensively. Furthermore, small sized resistors having a resistance value in excess of 30MΩ which have not been obtained on a commercial scale can be obtained.

The resinous resistor of the present invention has epoch-making advantages as described above and, thus, making use of these advantages, can be used as a resistor part for various electronics, or as a mechanical part having properties as a resistor. Therefore, the resinous resistor of the present invention can find various applications.

The present invention is described below in greater detail with reference to the following examples but the invention should not be construed as being limited to these examples.

EXAMPLE 1

Poly(α-methylstyrene), a styrene-acrylamide copolymer having a polar group-containing monomer content (by mol) of 0.3%, graphite and hydrogen-reduced Ketjen black having an oxygen content of 0.15 wt% were mixed in the formulation shown in Table 1, and kneaded and pelletized by the use of a twin-screw extruder. The pellets thus obtained were molded under conditions of temperature 240° C. and injection pressure 700 kg/cm$^2$ by the use of an injection molding machine having a mold clamping force of 100 tons to produce a rectangular molding having a length of 200 mm, a width of 40 mm and a thickness of 2 mm. For this molding, the value $$\left(\frac{c \times d}{a \times b}\right)$$

[wherein a indicates the oxygen content of carbon black (wt%), b indicates the amount of carbon black compounded (wt%), c indicates the polar group-containing monomer content (by mol) of the thermoplastic polar resin (%), and d indicates the amount of the thermoplastic polar resin compounded (wt%)] was 7.0.

For comparison, poly(α-methylstyrene), a styrene-acrylamide copolymer, graphite and Ketjen black were mixed in the formulation shown in Table 1 and then kneaded and injection molded in the same manner as in Example 1 to obtain a molding having the same shape as in Example 1.

These moldings were measured for characteristics as resistors. The results are shown in Table 1. As is apparent from the results in Table 1, the volume inherent resistance is controlled on the level of $1\times10^{12}$ Ω.cm in the resistor of the present invention, and, therefore, the resistor of the present invention is extremely excellent as a resistor having a volume inherent resistance in the above range. On the other hand, the volume inherent resistance of the comparative resistor is not in the range of $1\times10^{6}$ to $1\times10^{13}$ Ω.cm, or because of seriously large variations in the volume inherent resistance, the resistor is unsuitable for practical use.

EXAMPLE 2

A propylene-ethylene block copolymer (ethylene content: 15 wt%), an ethylene-2,2,6,6-tetramethylpiperidyl acrylate copolymer (polar group-containing monomer mol content: 0.7%), graphite and furnace black subjected to sintering treatment (oxygen content: 0.6 wt%) were mixed in the formulation shown in Table 2, and then kneaded and pelletized by the use of a twin-screw extruder. The pellets thus obtained were molded under conditions of temperature 260° C. and injection molding pressure 800 kg/cm$^2$ to produce a disc-shaped molding having a diameter of 20 mm and a thickness of 3 mm. For this molding, the value $$\left(\frac{c \times d}{a \times b}\right)$$

(wherein a, b, c and d each indicates the same significance as those in Example 1) was 1.9.

For comparison, a propylene-ethylene block copolymer, an ethylene-2,2,6,6-tetramethylpiperidyl acrylate copolymer, graphite and furnace black were mixed in the formulation shown in Table 2, and then kneaded and injection molded in the same manner as in Example 2 to produce a molding having the same shape as in Example 2.

These moldings were measured for characteristics as resistors. The results are shown in Table 2. As is apparent from the results in Table 2, in the resistor of the present invention, the volume inherent resistance is controlled on the level of $1\times10^{8}$ Ω.cm, and, thus, the resistor is extremely excellent as a resistor in the above range. On the other hand, in the comparative resistor, the volume inherent resistance does not fall within the range of $1\times10^{6}$ to $1\times10^{13}$ Ω.cm, or because of seriously large variations in the volume inherent resistance, the resistor is unsuitable for practical use.

TABLE 1

| | Example 1 | Comparative Example 1 | 2 | 3 | 4 |
|---|---|---|---|---|---|
| Formulation (wt %) | | | | | |
| Poly(α-methyl-styrene) | 48 | 73 | 69 | 0 | 21 |
| Styrene-Acrylamide Copolymer | 21 | 21 | 0 | 69 | 48 |
| Graphite | 25 | 0 | 25 | 25 | 25 |
| Hydrogen-Reduced Ketjen Black | 6 | 6 | 6 | 6 | 6 |
| $\frac{c \times d}{a \times b}$ | 7.0 | — | — | — | 16 |
| Evaluation | | | | | |
| Volume Inherent Resistance (Ω · cm) | Average: $4 \times 10^{12}$ Range: $3 \times 10^{12}$ to $5 \times 10^{12}$ | Not less than $1 \times 10^{14}$ | Not more than $1 \times 10^{5}$ | $3 \times 10^{12}$ to $9 \times 10^{14}$ (large variation) | $7 \times 10^{12}$ to $5 \times 10^{14}$ (large variation) |

TABLE 2

| | Example 2 | Comparative Example 5 | 6 | 7 | 8 |
|---|---|---|---|---|---|
| Formulation (wt %) | | | | | |
| Propylene-Ethylene Block Copolymer | 66 | 74 | 76 | 0 | 73.5 |
| Ethylene-2,2,6,6-Tetramethylpiperidyl Acrylate Copolymer | 10 | 20 | 0 | 76 | 2 |
| Graphite | 18 | 0 | 18 | 18 | 18 |
| Furnace Black Subjected to Sintering Treatment | 6 | 6 | 6 | 6 | 6 |
| $\frac{c \times d}{a \times b}$ | 1.9 | — | — | — | 0.4 |
| Evaluation | | | | | |
| Volume Inherent Resistance (Ω · cm) | Average: $3 \times 10^{8}$ Range: $2 \times 10^{8}$ to $4 \times 10^{8}$ | Not less than $1 \times 10^{14}$ | Not more than $1 \times 10^{5}$ | $3 \times 10^{10}$ to $9 \times 10^{13}$ (large variation) | Not more than $1 \times 10^{5}$ |

While the invention has been described in detail and with reference to specific embodiments thereof, it will be apparent to one skilled in the art that various changes and modifications can be made therein without departing from the spirit and scope thereof.

What is claimed is:

1. A resinous resistor produced by kneading and molding a resin composition comprising 40 to 90 wt% of a thermoplastic non-polar resin, 0.5 to 30 wt% of a thermoplastic polar resin, 5 to 30 wt% of graphite and 1 to 20 wt% of carbon black, said composition satisfying the following relation:

$$\frac{(c) \times (d)}{(a) \times (b)} = 0.5 \text{ to } 15$$

wherein:

(a) indicates the wt.% oxygen content of carbon black;

(b) indicates the wt.% amount of carbon black compounded;

(c) indicates the mol.% amount of polar group-containing monomer molar content of the thermoplastic polar resin; and (d) indicates the wt.% amount of thermoplastic polar resin compounded.

2. The resistor as claimed in claim 1, having a volume inherent resistance value of $1 \times 10^{6}$ to $1 \times 10^{13}$ Ω.cm.

3. The resistor as claimed in claim 1, wherein the resin composition comprises 60 to 90 wt% of the thermoplastic non-polar resin, 0.5 to 15 wt% of the thermoplastic polar resin, 10 to 25 wt% of the graphite and 1.5 to 15 wt% of the carbon black.

4. The resistor as claimed in claim 1, wherein the resin composition comprises 40 to 70 wt% of the thermoplastic non-polar resin, 10 to 30 wt% of the thermoplastic polar resin, 10 to 25 wt% of the graphite and 5 to 20 wt% of the carbon black.

5. The resistor as claimed in claim 1, wherein $(c \times d)/(a \times b) = 0.5$ to 4.

6. The resistor as claimed in claim 1, wherein $(c \times d)/(a \times b) = 3$ to 10.

7. The resistor as claimed in claim 1, wherein $(c \times d)/(a \times b) = 9$ to 15.

8. The resistor as claimed in claim 1, wherein the thermoplastic non-polar resin is a polyolefin-based or a polystyrene-based resin, and the thermoplastic polar resin is a homopolymer or a copolymer containing as a structural unit at least one member selected from the group consisting of acrylic acid, methacrylic acid, acrylic ester, methacrylic acid ester, acrylic amide and methacrylic acid amide.

9. The resistor as claimed in claim 1, wherein the thermoplastic non-polar resin is a polyolefin-based or polystyrene-based resin, and the thermoplastic polar resin is a polyolefin or a polystyrene grafted with at least one member selected from the group consisting of acrylic acid, methacrylic acid, acrylic ester, methacrylic acid ester, acrylic amide, methacrylic acid amide, maleic anhydride and maleimide compounds.

10. The resistor of claim 1, wherein said graphite has an average particle diameter of from 1 to 50 micrometers.

11. The resistor of claim 1, wherein said graphite has an average particle diameter of from 5 to 30 micrometers.

12. A resinous resistor, comprising a resin composition comprising 40 to 90 wt% of a thermoplastic non-polar resin, 0.5 to 30 wt% of a thermoplastic polar resin, 5 to 30 wt% of graphite, and 1 to 20 wt% of carbon black; said composition satisfying the following relation:

$$\frac{(c) \times (d)}{(a) \times (b)} = 0.5 \text{ to } 15$$

wherein:

(a) indicates the wt.% oxygen content of carbon black;

(b) indicates the wt.% amount of carbon black compounded;

(c) indicates the mol.% amount of polar group-containing monomer molar content of the thermoplastic polar resin; and (d) indicates the wt.% amount of thermoplastic polar resin compounded.

13. The resistor of claim 12, having a volume inherent resistance value of $1 \times 10^6$ to $1 \times 10^{13}$ Ω.cm.

14. The resistor of claim 12, wherein the resin composition comprises 60 to 90 wt% of the thermoplastic non-polar resin, 0.5 to 15 wt% of the thermoplastic polar resin, 10 to 25 wt% of the graphite and 1.5 to 15 wt% of the carbon black.

15. The resistor of claim 12, wherein the resin composition comprises 40 to 70 wt% of the thermoplastic non-polar resin, 10 to 30 wt% of the thermoplastic polar resin, 10 to 25 wt% of the graphite, and 5 to 20 wt% of the carbon black.

16. The resistor of claim 12, wherein $$\frac{(c) \times (d)}{(a) \times (b)} = 0.5 \text{ to } 4.$$

17. The resistor of claim 12, wherein $$\frac{(c) \times (d)}{(a) \times (b)} = 3 \text{ to } 10.$$

18. The resistor of claim 12, wherein $$\frac{(c) \times (d)}{(a) \times (b)} = 9 \text{ to } 15.$$

19. The resistor of claim 12, wherein the thermoplastic non-polar resin is a polyolefin-based or polystyrene-based resin, and the thermoplastic polar resin is a homopolymer or copolymer containing as a structural unit at least one member selected from the group consisting of acrylic acid, methacrylic acid, acrylic ester, methacrylic acid ester, acrylic amide and methacrylic acid amide.

20. The resistor of claim 12, wherein the thermoplastic non-polar resin is a polyolefin-based or polystyrene-based resin, and the thermoplastic polar resin is a polyolefin or a polystyrene grafted with at least one member selected from the group consisting of acrylic acid, methacrylic acid, acrylic ester, methacrylic acid ester, acrylic amide, methacrylic acid amide, maleic anhydride and maleimide compounds.

* * * * *